United States Patent [19]

Naylor

[11] 4,211,496

[45] Jul. 8, 1980

[54] PRINTING SOLENOID

[75] Inventor: James E. Naylor, Cazenovia, N.Y.

[73] Assignees: Small Business Administration, Elmira; Data Machines International, Inc., Ithaca, both of N.Y.

[21] Appl. No.: 7,569

[22] Filed: Jan. 29, 1979

[51] Int. Cl.[2] ..... B41J 3/10

[52] U.S. Cl. ..... 400/124; 101/93.05

[58] Field of Search ..... 400/124; 101/93.05; 335/255, 261, 278, 297, 299

[56] References Cited

U.S. PATENT DOCUMENTS

| | | | |
|---|---|---|---|
| 3,755,700 | 8/1973 | Buschmann et al. | 400/124 X |
| 3,787,791 | 1/1974 | Borger et al. | 400/124 X |
| 3,789,969 | 2/1974 | Howard et al. | 400/124 |
| 3,850,278 | 11/1974 | Mihm et al. | 400/124 |
| 3,897,865 | 8/1975 | Darwin et al. | 400/124 |
| 3,900,094 | 8/1975 | Larsen et al. | 400/124 |
| 3,940,726 | 2/1976 | Gershnow | 400/124 X |
| 4,004,671 | 1/1977 | Kondur | 101/93.05 X |
| 4,016,965 | 4/1977 | Wirth et al. | 400/124 |
| 4,044,878 | 8/1977 | Kunath | 101/93.05 X |

*Primary Examiner*—Paul T. Sewell

*Attorney, Agent, or Firm*—Brady, O'Boyle & Gates

[57] ABSTRACT

Disclosed is a printing solenoid for a high speed wire matrix printer which provides efficient operation at voltages in the order of 10 to 12 volts DC while maintaining a reduced physical size while at the same time drawing no noticeable increase in current over printing solenoids of comparable size which normally require 24 to 28 volts DC for their operation. The printing solenoid of the subject invention is comprised of a minimum number of parts including a three piece bobbin having a stainless steel core and cold rolled steel end pieces. Wound on the bobbin is a solenoid coil of a predetermined number of turns (300) of wire of a particular size (No. 29 AWG) which enables efficient operation at 12 volts DC. A spring biased armature to which is uniquely bonded a small diameter print wire is axially located within the bobbin and is operable for reciprocal movement upon the energization and deenergization of the solenoid coil.

11 Claims, 4 Drawing Figures

FIG.1
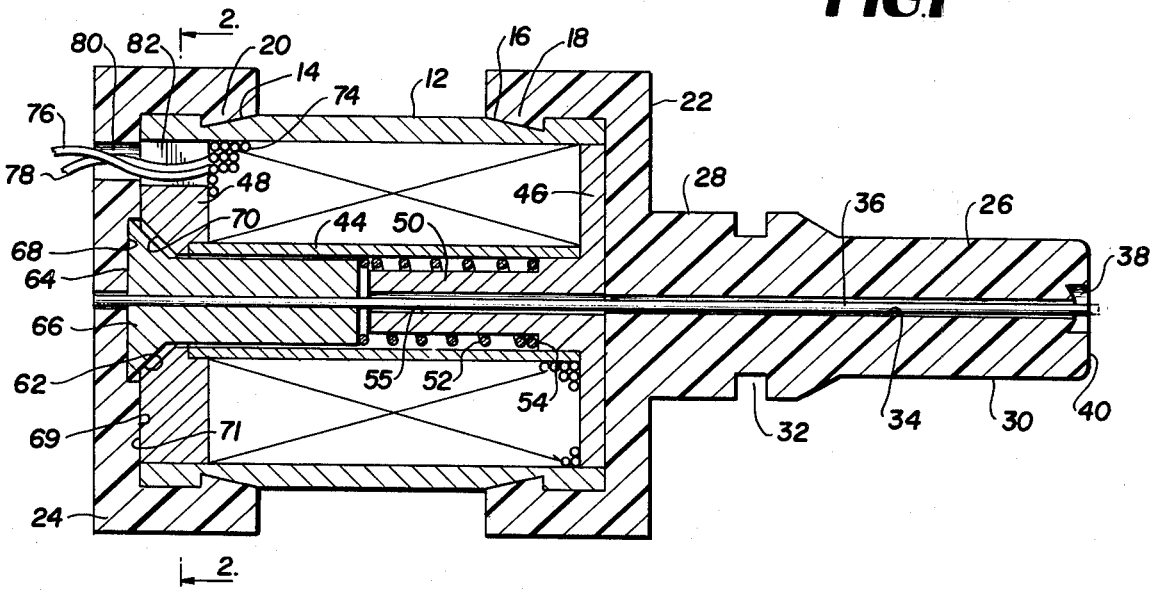
FIG.2
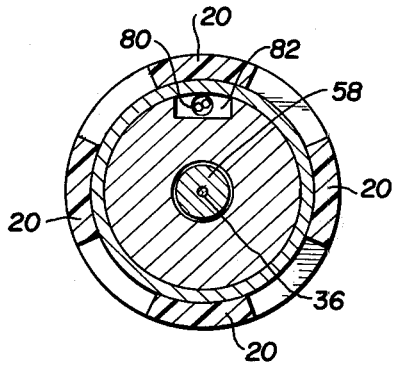
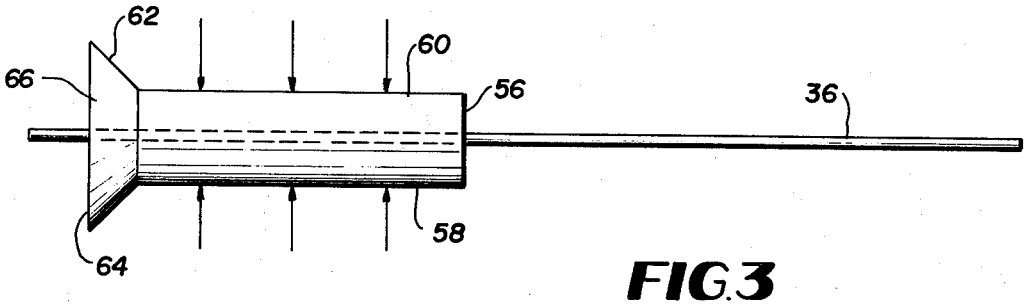
FIG.3

PRINTING SOLENOID

BACKGROUND OF THE INVENTION

The present invention relates generally to impact printing devices for dot matrix printing and more particularly to a new and improved solenoid configuraton therefor. Solenoid operated dot matrix printing devices are known and are disclosed, for example, in U.S. Pat. No. 3,897,865; U.S. Pat. No. 3,900,094; and U.S. Pat. No. 4,016,965. What is common to all of these prior art devices is a magnetic circuit which is adapted to reciprocally drive a relatively small diameter print wire against a media, e.g. printing paper at lhigh repetition rates. As these devices became smaller and smaller, highly efficient magnetic circuits with minimal coil heating became a necessity; however, up to the present time, relatively large operating voltages in the order of 24–28 volts DC are required for proper solenoid operation. It is to the latter prior art constraint that the present invention is directed.

SUMMARY OF THE INVENTION

It is the object of the present invention, therefore, to provide an improved print wire solenoid assembly having increased magnetic circuit efficiency and heat dissipation properties.

It is another object of the present invention to provide an improved printing solenoid which is adapted for relatively low voltage operation.

And it is yet another object of the present invention to provide improved printing solenoid having relatively few parts.

These and other objects are realized by a print wire solenoid comprised of a cylindrical housing havng angulated grooves formed in the outer surface at the opposite ends thereof for respectively retaining a rear end cap and a front end cap having a nose portion integrally formed therewith for mounting on a printer and providing a guide for the relatively small diameter printing wire which is swaged to a small generally cylindrical armature having a flared rear end portion which is adapted to normally abut a small bore formed in the inner face of the rear end cap. The armature and printing wire are adapted to reciprocally move axially within a three piece bobbin or spool comprised of a non-magnetic stainless steel core and cold rolled steel end pieces. The rear end piece of the bobbin includes a slanted recess for engaging the flared end portion of the armature when in an activated state. The front end piece of the bobbin includes a cylindrical portion of reduced diameter relative to the inner diameter of the core and projects inwardly back towards the armature and acts as retention means for a compression spring which is adapted to resiliently urge i.e. bias the armature in its unactivated state towards the rear end cap. A solenoid coil consisting of 300 turns of number 29 AWG single polyurethane copper magnet wire is wrapped around the stainless steel core to provide an optimized ampere turns configuration for efficient operation at low DC voltages, typically 12 volts DC. The stainless steel core provides for increased efficiency of the flux transfer from coil to armature as well as acting as an improved heat sink thus dissipating heat more efficiently and allowing cooler operation which aids in extending useful life.

The foregoing and other objects of the invention will become apparent from a following detailed description when considered in light of the figures making up the drawings.

BRIEF DESCRIPTION OF THE DRAWINGS

FIG. 1 is a longitudinal cross section of the preferred embodiment of the subject invention taken along its central axis;

FIG. 2 is a transverse cross sectional view of the embodiment shown in FIG. 1 taken along the lines 2—2 thereof;

FIG. 3 is a side planar view intended to show the armature of the embodiment shown in FIG. 1 and the print wire thereof being bonded to the armature by a swaging technique.

DESCRIPTION OF THE PREFERRED EMBODIMENT

Figure 4:
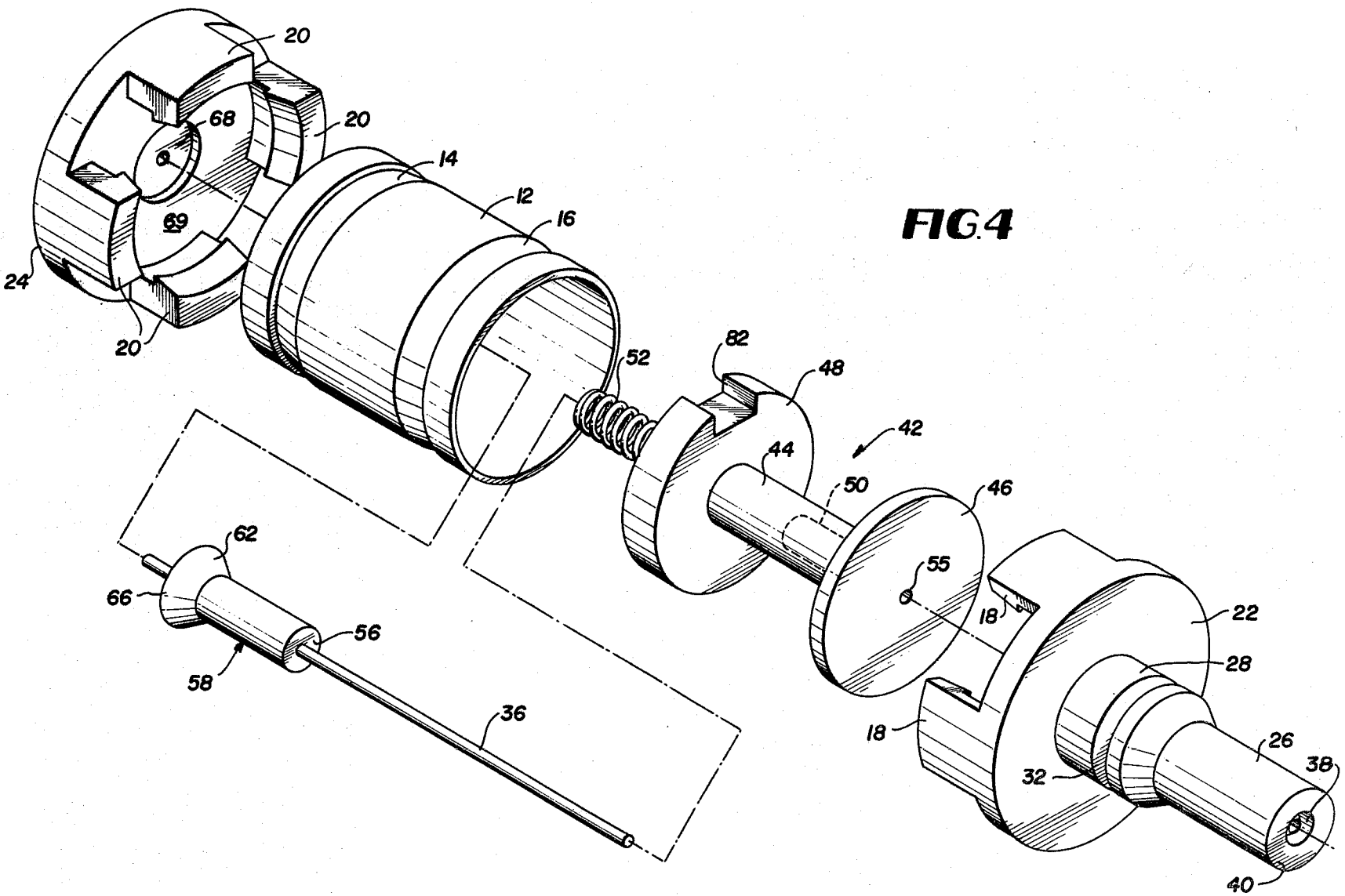
FIG. 4 is an exploded perspective view of the various parts which comprise the embodiment of the subject invention shown in FIG. 1.

Referring now to the drawings, FIG. 1 designates a generally cylindrical printing solenoid of relatively small size, typically in the order of 0.5 in. in outside diameter by 1.5 in. in overall length, which is to be used in a mini-computer printer, not shown, for generating various graphic and character founts as a result of repetitive pulsing that will lay down a dot matrix pattern. The solenoid as disclosed in FIGS. 1 and 4 includes a cylindrical housing 12, preferably comprised of metal, having a pair of angulated peripheral grooves 14 and 16 formed on the outer surface at substantially the same distance away from the respective ends. The grooves 14 and 16 angulate inwardly towards the ends of the housing and are adapted to engage respective distal portions 18 and 20 of front and rear end caps 22 and 24. The end caps 22 and 24 are preferably comprised of plastic and are adapted to be snapped on and be securely attached to the housing 12, being retained by the grooves 14 and 16.

The front end cap 22 additionally includes a protruding nose section 26 which includes an inner region 28 of relatively larger diameter than the outer region 30. A mounting groove 32 is formed in the inner region 28 for being mounted on wire printer apparatus, not shown. The front end cap 22 additionally includes an axial bore 34 which acts as a guide for a relatively small diameter print wire 36 which is typically 0.016 inches in diameter. The print wire 36 in its unactivated state, protrudes out of a small counter bore 38 but not beyond the tip 40. In its activated state the print wire 36 is adapted to project slightly beyond the tip 40, typically 0.022 inches, in order to make an impacted impression of a dot upon a given media, not shown.

Located within the housing 12 intermediate the end caps 22 and 24 is a three piece bobbin 42 (FIG. 4) consisting of a non-magnetic stainless steel cylindrical core 44 to which is attached front and rear end pieces 46 and 48 comprised of cold rolled steel. The peripheral diameters of the end pieces 46 and 48 are substantially equal to the inner diameter of the cylindrical housing 12. The front end piece 46 additionally includes an axially projecting cylindrical portion 50 which is adapted to project into the core 44 substantially to its mid point as shown in FIG. 1. The cylindrical portion 50 of the front end piece 46 is of a reduced diameter relative to the inner diameter of the core 44 and is adapted to accommodate and retain a compression spring member 52 inside of the core 44. One end of the spring 52 is adapted to abut the shoulder portion 54 of the front end piece 46 while its opposite end is adapted to contact the forward edge 56 of an armature 58 and acts as a bias spring for the armature 58 in its unactivated state. Also the portion 50 includes a bore 55 which also acts as a guide for the print wire 36 along with the bore 34 in front end cap 22.

Referring now to FIG. 3, the armature 58 itself consists of a generally cylindrical forward portion 60, which is adapted to slidably fit into the core 44, and an enlarged flared rear portion 62. The rear portion 62 has a flat rear surface 64 and a sloping intermediate surface portion 66 which are adapted to respectively contact rear and forward movement limit stops provided by the counter bores 68 and 70 formed in the inner surface 69 of the rear end cap 24 and the outer surface 71 of the rear end piece 48.

The armature 58 is comprised of magnetizable material e.g. iron and includes a hole 72 therethrough for holding the print wire 36 in a fixed position relative thereto. The print wire 36 is pressed into the hole 72 and thereafter gently but uniformly swaged i.e. squeezed by means, not shown, around the periphery of the cylindrical portion 60. A constant pressure is applied as shown in FIG. 3, whereupon the print wire 36 is firmly held while the armature portion 60 maintains its dimensional integrity. This type of construction overcomes a known problem area encountered in other known types of printing solenoids which have been known to malfunction due to the constant pounding that the armature-print wire component receives during its useful life span. It has been discovered that an armature-print wire subassembly constructed in accordance with a swaging technique as shown in FIG. 3 solves the problem and useful life can be appreciably extended.

The preferred embodiment of the subject invention also includes a wire solenoid in the form of an electrical coil 74 wound on the stainless steel core 44 and when energized is adapted to generate a magnetic field which is operable to move the applied armature 58 in a forward direction against the restraining or biasing action of the spring 52 causing the print wire 36 to project out of the nose portion 30 of the front end cap 22. The coil winding 74 preferably is comprised of 300 turns of No. 29 AWG single polyurethane copper magnet wire. A pair of electrical leads 76 and 78 are connected to the coil 74 and extend through a hole 80 in the rear end cap 24 and a slot 82 formed in the rear end piece 48 for being coupled to a controlled source of voltage, not shown, which when applied energizes the coil in a well known manner.

What is significant about the subject invention is that the unique combination of the solenoid coil 74 consisting of 300 turns of No. 29 AWG wire wound on the three piece bobbin 42 consisting of the stainless steel core 44 and the cold rolled steel end pieces 46 and 48 is adapted to provide efficient operation for applied voltages in the order of 10 to 12 volts DC without appreciably increasing current flow, a result heretofore unattainable in prior art devices. This is a direct result of the wire resistance and ampere turns achieved thereby. Additionally, the stainless steel core 44 being non-magnetic is adapted to maximize the useable percentage of flux coupled to the armature 58 thereby providing greater efficiency because the residual magnetism potential is diverted. Also, there is a decrease in the magnetic flux losses found in conventional bobbins. Accordingly, increased efficiency in flux transfer from coil to armature is achieved. Additionally, a bobbin design utilizing the stainless steel core as taught by the subject invention has an increased efficiency as a heat sink over prior art bobbins which are normally constructed of plastic material. The unitized steel bobbin inherently dissipates heat more efficiently and allows cooler operation of the solenoid and therefore helps to extend the useful life of the device.

Printing solenoids constructed in accordance with the features set forth above and energized by a pulse of 12 volt DC control voltage have been observed to have an accurate repeat time of slightly less than 800 microseconds. This repeat cycle includes the initial energizing pulse coupled to the coil, moving the armature-print wire to the media, the bias spring restoring the armature-print wire to the rest/home position and time for the print wire to settle while awaiting the next electrical pulse.

While the foregoing description has been set forth with a certain degree of particularity, it has been done so for the purposes of explanation but not limitation. Accordingly, it is to be understood that various changes in form and details may be made without departing from the spirit and scope of the present invention as defined in the following claims.

What is claimed is:

1. A wire printer solenoid assembly particularly adapted for low voltage, typically 12 volt DC operation, comprising, in combination:

a generally cylindrical solenoid housing having end cap retaining means fore and aft on the outer surface thereof;

a front and rear end cap, each having at least one distal projection, engageable with said retaining means on said housing;

said front end cap including a forwardly projecting nose section and additionally including an axial bore therein adapted to operate as a guide for an axially moveable print wire;

a three piece bobbin located in said housing intermediate said end caps and consisting of front and rear end pieces secured to opposite ends of a non-magnetic stainless steel cylindrical core having a wire solenoid in the form of an electrical coil wound thereon;

said front end piece having a cylindrical portion projecting into said cylindrical core and having an axial bore therein also adapted to operate as a guide for said print wire and having a reduced diameter portion with respect to the inner diameter of said core to provide a space for a compression spring and terminating in a larger diameter portion for acting as an abutment for a compression spring;

a compression spring located in said core around said projecting cylindrical portion of said front end piece and having one end contacting said larger diameter portion;

a length of print wire;

an armature secured in a predetermined manner to said length of print wire and being located partially at least in said cylindrical core and reciprocally moveable therein and being in contact with said compression spring which acts to bias said armature against said rear cap when the wire solenoid is unenergized, said armature however being moved forward until stopped by the rear end piece of said bobbin when the wire solenoid is energized whereupon said print wire projects from the nose portion of said front end cap and thereby makes an impacted impression of a dot upon a given media.

2. The assembly as defined by claim 1 wherein said electrical coil wound on said stainless steel core of said bobbin consists of a predetermined plurality of turns of No. 29 AWG wire.

3. The assembly as defined by claim 2 wherein said predetermined plurality of turns comprises substantially 300 turns of No. 29 AWG wire the combination of which provides the proper wire resistance and ampere turns for effecting efficient low current operation upon the application of relatively low energization voltages in the 12 volt DC range.

4. The assembly as defined by claim 1 wherein said armature includes a cylindrical forward portion which is swaged around said print wire for securing said print wire to said armature member.

5. The assembly as defined by claim 1 wherein said front and rear end pieces secured to said stainless steel cylindrical core is comprised of cold rolled steel.

6. The assembly as defined by claim 1 wherein said armature includes a cylindrical forward portion projecting into said cylindrical core and abutting the opposite end of said compression spring and being urged rearwardly thereby, and additionally including an enlarged rear portion having a flat rear surface and a flared intermediate surface;

said rear cap including an axial counter bore on its inner surface adapted to receive the flat rear surface of the enlarged portion of said armature member to provide a rearward motion limit stop for the armature when the wire solenoid is unenergized; and said rear end piece of said bobbin including a flared counter bore on its outer surface to receive the flared intermediate surface of said armature to provide a forward motion limit stop for the armature when the wire solenoid is energized.

7. The assembly as defined by claim 6 wherein said rear end cap includes an opening therein and said rear end piece of said bobbin includes a slot therein, a pair of electrical leads passing through said opening and said slot and being coupled to said coil for the application of an energization voltage.

8. The solenoid assembly as defined by claim 1 wherein said end cap retaining means comprises respective grooves formed on the outer surface of said housing.

9. The assembly as defined by claim 1 wherein said end cap retaining means comprises respective angulated grooves formed on the outer surface of said housing and wherein said front and rear end cap each have plural distal projections engageable with a respective angulated groove.

10. The assembly as defined by claim 9 wherein said plural distal projections terminate in angulated end surfaces which are adapted to fit the angulated grooves of said retaining means.

11. The solenoid assembly as defined by claim 10 wherein said solenoid housing consists of a metal housing wherein said front and rear end caps are comprised of plastic material.

* * * * *